US009233458B2

(12) United States Patent
Schmidt et al.

(10) Patent No.: US 9,233,458 B2
(45) Date of Patent: Jan. 12, 2016

(54) INSTALLATION METHOD FOR AN EXPANSION ANCHOR AND IMPACT SCREWDRIVER FOR INSTALLING AN EXPANSION ANCHOR

(75) Inventors: Peer Schmidt, Lindau (DE); Joerg Appl, Buchs (CH); Serhey Khandozhko, Buchs (CH)

(73) Assignee: HILTI AKTIENGESELLSCHAFT, Schaan (LI)

( * ) Notice: Subject to any disclaimer, the term of this patent is extended or adjusted under 35 U.S.C. 154(b) by 917 days.

(21) Appl. No.: 13/405,817

(22) Filed: Feb. 27, 2012

(65) Prior Publication Data

US 2012/0222876 A1 Sep. 6, 2012

(30) Foreign Application Priority Data

Mar. 4, 2011 (DE) ..... 10 2011 005 079

(51) Int. Cl.

| | |
|---|---|
| ***B25B 21/02*** | (2006.01) |
| ***B25B 23/151*** | (2006.01) |
| ***B25B 31/00*** | (2006.01) |
| ***B25B 23/147*** | (2006.01) |

(52) U.S. Cl.

CPC ..... *B25B 31/00* (2013.01); *B25B 21/02* (2013.01); *B25B 23/1475* (2013.01)

(58) Field of Classification Search

CPC .... B25B 21/02; B25B 21/002; B25B 21/023; B25B 23/1475; B25B 23/151

USPC ..... 173/1, 2, 6, 11, 176

See application file for complete search history.

(56) References Cited

U.S. PATENT DOCUMENTS

| | | | | |
|---|---|---|---|---|
| 3,821,991 | A * | 7/1974 | Alexander | 173/180 |
| 3,975,954 | A * | 8/1976 | Barnich | 73/862.23 |
| 2002/0033267 | A1* | 3/2002 | Schweizer et al. | 173/2 |
| 2005/0263303 | A1 | 12/2005 | Shimizu et al. | |
| 2005/0263304 | A1* | 12/2005 | Sainomoto et al. | 173/2 |
| 2011/0308827 | A1* | 12/2011 | Kaufmann | 173/1 |

FOREIGN PATENT DOCUMENTS

| | | |
|---|---|---|
| DE | 9111449 | 1/1992 |
| DE | 19738094 | 3/1999 |
| DE | 602005002183 | 5/2008 |
| EP | 1 188 521 | 3/2002 |
| EP | 1 447 177 | 8/2004 |
| EP | 1 595 649 | 11/2005 |
| EP | 2140978 | 1/2010 |
| GB | 2328635 | 3/1999 |

* cited by examiner

*Primary Examiner* — Michelle Lopez

(74) *Attorney, Agent, or Firm* — Davidson, Davidson & Kappel, LLC

(57) ABSTRACT

An installation method for an expansion anchor is carried out by repeatedly exerting rotary-percussive strikes onto the shank (2) of the expansion anchor (1) by an impact screwdriver. The repeat rate ($N_{target}$) of the rotary-percussive strikes is selected as a function of the tightening torque prescribed for expanding the expansion sleeve (3) of the expansion anchor (1). The impact screwdriver stops generating rotary-percussive strikes when the detected mean rotational speed (d) of the shank falls below a threshold value (D).

4 Claims, 2 Drawing Sheets

INSTALLATION METHOD FOR AN EXPANSION ANCHOR AND IMPACT SCREWDRIVER FOR INSTALLING AN EXPANSION ANCHOR

This claims the benefit of German Patent Application DE 10 2011 005 079.5, filed Mar. 4, 2011 and hereby incorporated by reference herein.

The present invention relates to an installation method for an expansion anchor and to an impact screwdriver for installing an expansion anchor, preferably by means of the above-mentioned installation method.

BACKGROUND

Expansion anchors are inserted into a pre-drilled hole and then their shanks are normally tightened using a torque wrench. It has proven necessary to employ a torque wrench because the user cannot see whether the expansion anchor inserted into the hole has expanded, that is to say, whether it has been installed properly. During this process, problems occur if the expansion is insufficient, meaning that the anchor does not have adequate holding force in the substrate, and also if the expansion is excessive, since this might cause fatigue of the expansion anchor. Accordingly, manufacturers of expansion anchors indicate the appropriate tightening torque at which the torque wrench should be set for the installation procedure.

SUMMARY OF THE INVENTION

It is an object of the present invention to provide an installation method for an expansion anchor comprising the following steps. An impact screwdriver is used to exert repetitive rotary-percussive strikes onto the shank of the expansion anchor, a process in which the repeat rate of the rotary-percussive strikes is selected as a function of the tightening torque prescribed for expanding the expansion sleeve of the expansion anchor. The impact screwdriver stops generating rotary-percussive strikes when the detected mean rotational speed of the shank falls below a threshold value.

The present invention provides an impact screwdriver for installing an expansion anchor has an input device for entering the type of expansion anchor or the tightening torque for the expansion anchor. An impact mechanism of the impact screwdriver serves to generate repetitive rotary-percussive strikes. A control unit sets the repeat rate of the rotary-percussive strikes as a function of the type of expansion anchor or of the entered tightening torque. A sensor serves to detect the rotational speed of the shank in response to which a switch-off device deactivates the impact mechanism when the detected rotational speed falls below a threshold value.

BRIEF DESCRIPTION OF THE DRAWINGS

The description below explains the invention on the basis of embodiments provided by way of example and on the basis of figures. The figures show the following.

DETAILED DESCRIPTION

Figure 1:
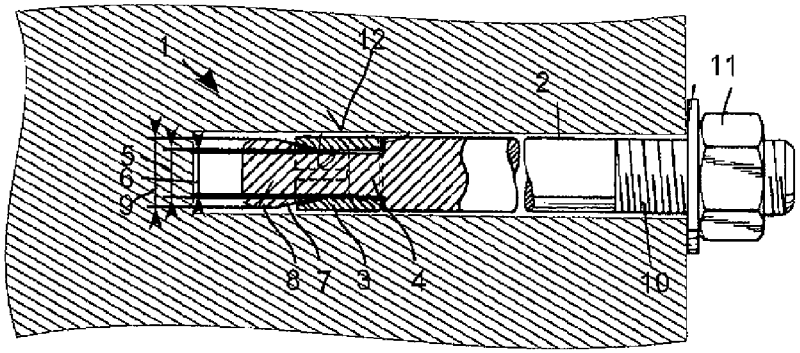
FIG. 1: an expansion anchor.
Figure 2:
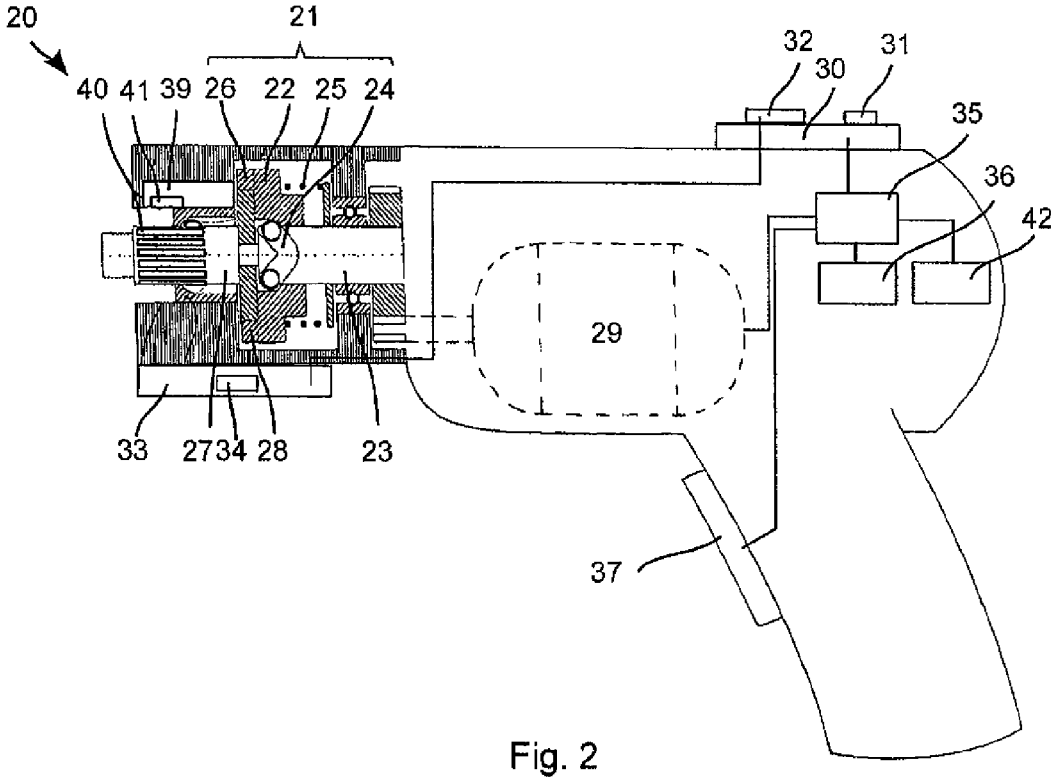
FIG. 2: an impact screwdriver.
Figure 3:
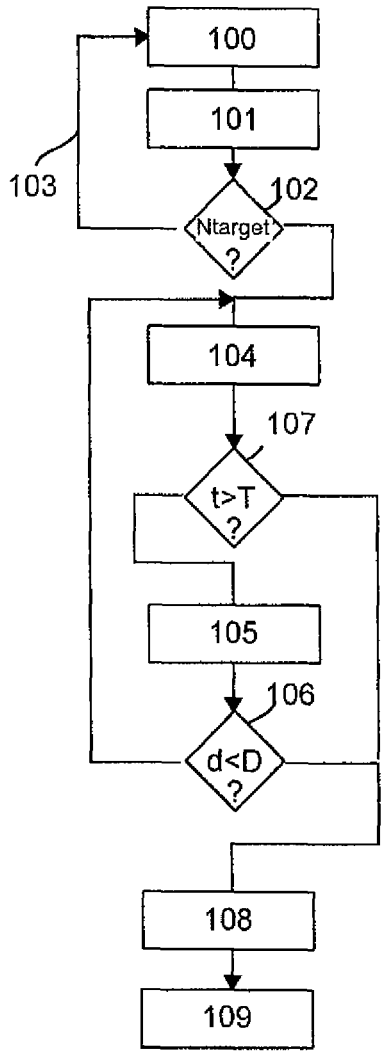
FIG. 3: a control sequence of the impact screwdriver.

Unless otherwise indicated, identical elements or elements having the same function are designated with the same reference numerals in the figures.

FIG. 1 shows an example of an expansion anchor 1 including a shank 2 and an expansion sleeve 3. The expansion sleeve 3 surrounds the circumference of a cylindrical section 4 of the shank 2. The outer diameter 5 of the cylindrical section 4 is preferably somewhat smaller than the inner diameter 6 of the expansion sleeve 3, as a result of which the shank 2 can be moved axially with respect to the expansion element 3. The cylindrical section 4 makes a transition to a conical section 7 that forms an expansion body 8 for expanding the expansion anchor 3. The largest diameter of the conical section 7 is larger than the inner diameter 6 of the expansion sleeve 3 and preferably smaller than the outer diameter 9 of the expansion sleeve 3. The shank 2 has a thread 10 by means of which a tensile force can be exerted. In the expansion anchor 1 provided by way of an example, the thread 10 at the same time serves to attach loads. During installation, the expansion anchor 1, with its expansion body 8 in front, is inserted into a drilled hole having a diameter equal to the outer diameter of the unexpanded expansion sleeve 3. A nut 11 is screwed onto the thread 10 and tightened until the shank 2 along with the expansion body 8 has been pulled into the expansion sleeve 3. In this process, the expansion sleeve 3 is firmly clamped to a wall 12 of the drilled hole. The expansion anchor 1 has been properly installed when the expansion sleeve 3 has expanded radially by a given value. The user can recognize this situation when the shank 2 no longer turns at a specific tightening torque.

Other expansion anchors can have, for example, a bolt with a counter-thread that engages with the thread 10 of the shank 2. During the installation, the user places a screwdriving tool onto the bolt, thus pulling the shank 2 with the expansion body 8 into the expansion sleeve 3.

The expansion anchors 1 provided by way of an example can be installed using an adapted impact screwdriver 20. The impact screwdriver 20 has an impact mechanism 21 that generates periodic rotary-percussive strikes. A hammer 22 is mounted on a driving shaft 23 by means of a spiral sliding block 24. A spring 25 pushes the hammer 22 along the driving shaft 23 towards an anvil 26. The anvil 26 is rigidly joined to a driven shaft 27. The driving shaft 23 and the driven shaft 27 can be rotated relative to each other. Along the driving shaft 23, the hammer 22 and the anvil 26 have projecting claws 28 by means of which the hammer 22 can transmit a torque to the anvil 26. An electric motor 29 drives the driving shaft 23. One cycle of a rotary-percussive strike has essentially the following phases. The claws 28 of the hammer 22 rest against the anvil 26. Owing to the sliding block 24, the rotating driving shaft 23 pulls the hammer 22 away from the anvil 26 against the force of the spring 25 until the claws 28 are disengaged from the anvil 26. Driven by the spring 25, the hammer 22 moves in the direction of the anvil 26, a process in which the sliding block 24 is made to rotate. The claws 28 ultimately strike against the anvil 26 tangentially.

One embodiment of the impact screwdriver 20 has an input device 30 by means of which a user can enter a tightening torque of the expansion anchor 1. The input device 30 comprises, for example, a pushbutton 31 or a keypad as well as a display element 32. As an alternative or in addition, an input device can be provided by means of which the user can select the type of expansion anchor. For instance, there are two pushbuttons for selecting the model of the expansion anchor and the size of the expansion anchor. The selected type can be shown, for example, in a display or by means of several LEDs.

Another embodiment of the impact screwdriver has a detection means or detector 33 that ascertains the type of the expansion anchor 1. The detection means 33 comprises, for instance, a reading unit 34 for an RFID chip. The ascertained type can be transmitted to the input device 30, among other things, so that the detected type can be displayed to the user. The detection means 33 can also encompass a camera that determines the type of expansion anchor on the basis of its shape and size.

A control unit 35 reads in the tightening torque entered by means of the input device 30 or by the detection means 33 (step 100). On the basis of the tightening torque entered, the control unit 35 ascertains the rotational speed $N_{target}$ for the driving shaft 23 (step 101). For example, rotational speeds associated with various tightening torques are stored in a memory unit 36. Once a user has activated the electric motor 29 by means of a pushbutton 37, the control unit 35 checks whether a rotational speed N has already been prescribed (step 102), in other words, for instance, by prescribing the anchor type or the tightening torque. The control unit 35 can prevent activation of the motor 29, for example, if no tightening torque has been selected, and can instead prompt the user to provide an input (step 103). The control unit 35 regulates the electric motor 29 in such a way that the driving shaft 23 turns at the prescribed rotational speed N (step 104). The rotational speed of the driving shaft 23 prescribes the repeat rate of the rotary-percussive strikes. It has been recognized that lowering the rotational speed not only reduces the frequency of the rotary-percussive strikes, something which is immaterial for the installation of the expansion anchor, but also that the torque exerted diminishes with each rotary-percussive strike. Each of the rotational speeds is associated with a torque, although with a large tolerance. In one configuration, the impact screwdriver 38 starts to turn the shank 2 at its maximum possible rotational speed. After a certain period of time, which is preferably prescribed by the type of expansion anchor 1 that has been entered, the impact screwdriver lowers the rotational speed to the rotational speed prescribed as a function of the tightening torque.

A rotational speed sensor 39 is arranged on the driven shaft 27. The rotational speed sensor 39 comprises, for example, several axial ribs 40 that are arranged along the circumference of the driven shaft 27 at constant first angular distances. Two magnetic-field sensors 41, e.g. Hall sensors, are arranged with respect to each other so as to be offset at a second angular distance. The second angular distance modulo the first angular distance is within the range from 20% and 33% of the first angular distance. The rotational speed sensor 39 detects not only the rotational speed but also the direction of rotation of the driven shaft 27. After one rotary-percussive strike, the driven shaft 27 can move opposite to the prescribed direction of rotation. On the basis of the rotational direction, the rotational speed sensor 39 ascertains the effective rotational speed d of the driven shaft 27 in the prescribed direction of rotation (step 105), for instance, by means of an integrator. The rotational speed d of the driven shaft 27 is essentially identical to the rotational speed of the shank 2 and therefore serves as a measure of the progress of the rotation of the shank or of its axial movement relative to the expansion sleeve 3.

The impact screwdriver 20 compares the detected rotational speed d of the driven haft 27 with a prescribed threshold value D for the rotational speed (step 106). If the mean rotational speed d lies below the threshold value D, the control unit 35 switches off the motor 29 (step 109). The driven shaft 27 now moves in the center around a very small angle or else not at all any longer. The threshold value D can be prescribed, for example, as a fixed value by the impact screwdriver 20. In addition, the impact screwdriver 20 can stop generating the rotary-percussive strikes once a maximum duration T for the installation of an expansion anchor 1 after actuation of the pushbutton 37 has lapsed (step 107). For this purpose, the control unit 35 can detect the time t that has elapsed since the actuation of the pushbutton 37. This can be due to faulty behavior of the expansion anchor 1, for instance, the expansion sleeve 3 rotates along in the drilled hole. The impact screwdriver 20 recognizes this as a faulty behavior and emits a warning signal to this effect.

In one refinement, the impact screwdriver 20 can have a recording device 42 that records a log for each expansion anchor 1 that has been installed (step 108). The recording device 42 comprises, for example, a memory module and a communication interface for outputting the content of the memory module. The expansion anchors 1 are provided with an unambiguous identifier, for instance, the number of an RFID chip. Prior to the installation of an expansion anchor 1, the detection means 33 ascertains its unambiguous identifier. If an automatic identification is not successful or not provided for, the identifier can be entered manually. During the installation, it is possible, for instance, to record the number of rotary-percussive strikes or the duration of the installation procedure. Alternatively or additionally, it can be recorded how the rotational speed of the driven shaft 27 changes, especially the rotational speed at the point in time when the impact screwdriver is switched off. In this context, the rotational speed is also recorded when the user finishes the installation of the expansion anchor 1 by releasing the pushbutton 37. The data logged by the recording device 42 can be read out by means of a wireless or hard-wired interface.

What is claimed is:

1. An installation method for an expansion anchor carried out by repeatedly exerting rotary-percussive strikes onto a shank of the expansion anchor by an impact screwdriver, the method comprising:

selecting a repeat rate of the rotary-percussive strikes as a function of a tightening torque prescribed for expanding an expansion sleeve of the expansion anchor; and stopping the impact screwdriver from generating the rotary-percussive strikes when a detected mean rotational speed of the shank falls below a threshold value, wherein, for a first time period, the impact screwdriver exerts the rotary-percussive strikes onto the shank at a maximum possible repeat rate for the impact screwdriver and, after the first time period, switches over to the selected repeat rate.

2. The installation method as recited in claim 1 wherein the impact screwdriver selects the repeat rate in response to an input indicating a type of expansion anchor or the tightening torque.

3. The installation method as recited in claim 1 wherein the impact screwdriver detects a duration of the installation method of the expansion anchor and emits a warning signal when the duration exceeds a threshold value.

4. The installation method as recited in claim 1 wherein a recording device of the impact screwdriver records one or more of the following parameters during generation of the rotary-percussive strikes: identification of the expansion anchor, a number of rotary-percussive strikes exerted onto the expansion anchor, a duration of the rotary-percussive strikes exerted onto the expansion anchor, a termination of the installation procedure by the user, and cases in which the mean rotational speed of the shank falls below the threshold value.

* * * * *